US009210510B2

(12) United States Patent
Kang et al.

(10) Patent No.: US 9,210,510 B2
(45) Date of Patent: Dec. 8, 2015

(54) DISPLAY APPARATUS AND SOUND CONTROL METHOD THEREOF

(71) Applicant: SAMSUNG ELECTRONICS CO., LTD., Suwon-si (KR)

(72) Inventors: Bo-suk Kang, Anyang-si (KR); Eung-sik Yoon, Suwon-si (KR); Yong-jin Kang, Suwon-si (KR); Woo-jin Han, Suwon-si (KR); Sun-ho Yang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 219 days.

(21) Appl. No.: 14/066,864

(22) Filed: Oct. 30, 2013

(65) Prior Publication Data

US 2014/0185842 A1 Jul. 3, 2014

(30) Foreign Application Priority Data

Jan. 3, 2013 (KR) ..... 10-2013-0000582

(51) Int. Cl.
*H04R 5/02* (2006.01)

(52) U.S. Cl.
CPC ..... *H04R 5/02* (2013.01); *H04R 2205/024* (2013.01)

(58) Field of Classification Search
CPC ..... H04R 5/02; H04R 27/00; H04R 2420/07; H04R 2205/024; H04R 5/04; H04R 2227/003; H04R 2203/12
USPC ..... 381/303
See application file for complete search history.

(56) References Cited

U.S. PATENT DOCUMENTS 8,082,051 B2 * 12/2011 Mihelich et al. ..... 700/94
8,126,172 B2 * 2/2012 Horbach et al. ..... 381/303
8,681,997 B2 * 3/2014 Karaoguz ..... 381/17
8,932,134 B2 * 1/2015 Andall ..... 463/35

FOREIGN PATENT DOCUMENTS

JP 2006-229738 A 8/2006
JP 2007-060253 A 3/2007
JP 2008-154130 A 7/2008

OTHER PUBLICATIONS

Communication dated Nov. 29, 2013, issued by the Korean Intellectual Property Office in counterpart Korean Application No. 10-2013-0000582.
Communication dated Feb. 7, 2014, issued by the Korean Intellectual Property Office in counterpart Korean Application No. 10-2013-0000582.

* cited by examiner

*Primary Examiner* — Mark Blouin
(74) *Attorney, Agent, or Firm* — Sughrue Mion, PLLC

(57) ABSTRACT

A display apparatus connectable to a plurality of external sound output devices and a sound control method thereof. The display apparatus includes: a wireless communication section which wirelessly communicates with a plurality of external sound output devices; a sound signal processor which processes a sound signal; a first sound output section and a second sound output section which output sounds corresponding to the sound signals; and a controller which determines positions of respective sound output devices based on distances between the first sound output section and the respective sound output devices and distances between the second sound output section and the respective sound output devices, and controls the sound signal processor so that the sound signals processed corresponding to the determined positions can be respectively transmitted to the plurality of sound output devices.

20 Claims, 7 Drawing Sheets

DISPLAY APPARATUS AND SOUND CONTROL METHOD THEREOF

CROSS-REFERENCE TO RELATED APPLICATION

This application claims priority from Korean Patent Application No. 10-2013-0000582, filed on Jan. 3, 2013 in the Korean Intellectual Property Office, the disclosure of which is incorporated herein by reference.

BACKGROUND

1. Field

Apparatuses and methods consistent with the exemplary embodiments relate to a display apparatus and a sound control method thereof, and more particularly to a display apparatus connectable to a plurality of external sound output devices and a sound control method thereof.

2. Description of the Related Art

With rapid development of multimedia technology, it has become possible to watch a high definition image from a large-sized screen of a display apparatus and listen sound of a grand and full sound audio source from a loudspeaker, using various multimedia resources such as a high definition television (HDTV), a digital television (DTV), etc.

Also, the thickness of the display apparatus has become thinner in order to meet consumer's demands, and therefore a loudspeaker requiring a certain volume has been provided in the form of an audio apparatus separately from the display apparatus.

As the display apparatus and the audio apparatus are separated, there is a need of connection for transferring audio data between the display apparatus and the audio apparatus. For the data transfer between the display apparatus and the audio apparatus, the display apparatus and the audio apparatus are generally connected by a wired cable. Also, in the case where the audio apparatus supports multi-channels such as 5.1 channels, the audio apparatus, a separate loudness speaker and a separate wired cable have been used for the data transfer in the audio apparatus.

As a result, the display apparatus and the audio apparatus, or the audio apparatus and the loudspeaker have to be connected by wireless cables, and therefore the wireless cables are connected across a listening space of a user. Accordingly, problems of troublesome connection, restrictive installation, and bad appearance have arisen.

Also, a user has to manually set the audio apparatus in order to achieve a sound effect optimized arrangement and positions of the audio apparatus. Accordingly, it may be inconvenient for a user who uses a multi-channel audio apparatus.

SUMMARY

One or more exemplary embodiments may provide a display apparatus, which can wirelessly connect with a plurality of sound output devices and automatically recognize positions of the plurality of sound output devices to thereby set up a sound, and a sound control method thereof.

Also, one or more exemplary embodiments may provide a display apparatus, which can take a position of a user into account to set up a sound of a plurality of sound output devices, and a sound control method thereof.

According to an aspect of an exemplary embodiment, a display apparatus may include a wireless communication section which wirelessly communicates with a plurality of external sound output devices; a sound signal processor which processes a sound signal; a first sound output section and a second sound output section which output sounds corresponding to the sound signals; and a controller which determines positions of respective sound output devices based on distances between the first sound output section and the respective sound output devices and distances between the second sound output section and the respective sound output devices, and controls the sound signal processor so that the sound signals processed corresponding to the determined positions can be respectively transmitted to the plurality of sound output devices.

According to an aspect of another exemplary embodiment, the controller may synchronize for clocks with the plurality of sound output devices when wireless connection of the plurality of sound output devices are wirelessly connected.

According to an aspect of another exemplary embodiment, each sound output devices may include a microphone, the first sound output section and the second sound output section output preset sound patterns, and the controller which controls the wireless communication section to receive latency information about the sound patterns received in the respective microphones of the plurality of sound output devices, and calculates distances between the first sound output section and the respective sound output devices and distances between the second sound output section and the respective sound output devices based on the received latency information.

According to an aspect of another exemplary embodiment, the controller may calculate angles between angles between the first sound output section and the respective sound output devices and between the second sound output section and the respective sound output devices based on the distances between the first sound output section and the respective sound output devices, the distances between the second sound output section and the respective sound output devices, and the distance between the first sound output section and the second sound output section, and calculates coordinates of the respective sound output devices based on the distances and the angles.

According to an aspect of another exemplary embodiment, the display apparatus may further include a user remote section including a microphone capable of receiving a sound, and the controller may receive latency information about the sound pattern, received in the microphone of the user remote section, through the wireless communication section, determines a position of the user remote section based on the received latency information, determines relative positions between the user remote section and the respective sound output devices, and control the sound signal processor so that the sound signal processed corresponding to the determined relative positions can be respectively transmitted to the plurality of sound output devices.

According to an aspect of another exemplary embodiment, the display apparatus may further include a first microphone and a second microphone adjacent to the first sound output section and the second sound output section, and the controller may calculate the distances between the first sound output section and the respective sound output devices and the distances between the second sound output section and the respective sound output devices, based on the latency information of the received sound pattern, when the first microphone and the second microphone receive preset sound patterns respectively output from the plurality of sound output devices.

According to an aspect of another exemplary embodiment, the controller may calculate angles between the first sound output section and the respective sound output devices and between the second sound output section and the respective sound output devices, based on the distances between the first sound output section and the respective sound output devices, the distances between the second sound output section and the respective sound output devices, and the distance between the first sound output section and the second sound output section, and calculate coordinates of the respective sound output devices based on the distances and the angles.

According to an aspect of another exemplary embodiment, the display apparatus may further include a user remote section including a third microphone capable of receiving a sound, and the controller may receive latency information about the sound pattern, received in the third microphone of the user remote section, through the wireless communication section, determine relative positions between the user remote section and the respective sound output devices based on the received latency information, and control the sound signal processor so that the sound signal processed corresponding to the determined relative positions can be respectively transmitted to the plurality of sound output devices.

According to an aspect of another exemplary embodiment, a sound control method of a display apparatus may include a first sound output section and a second sound output section which output sounds, the sound control method including: setting up wireless communication with a plurality of sound output devices; calculating distances between the first sound output section and the respective sound output devices and distances between the second sound output section and the respective sound output devices; determining positions of the respective sound output devices based on the distances; processing the sound signals corresponding to the determined positions; and transmitting the processed sound signals to the respective sound output devices.

According to an aspect of another exemplary embodiment, the sound control method may further include synchronizing clocks with the plurality of sound output devices when the plurality of sound output devices are wirelessly connected.

According to an aspect of another exemplary embodiment, the respective sound output devices may include microphones, and the sound control method including: by the first sound output section and the second sound output section, outputting preset sound patterns; receiving latency information about the sound patterns received in the respective microphones of the plurality of sound output devices, through wireless communication; and calculating distances between the first sound output section and the respective sound output devices and distances between the second sound output section and the respective sound output devices based on the latency information.

According to an aspect of another exemplary embodiment, the sound control method may further include calculating angles between angles between the first sound output section and the respective sound output devices and between the second sound output section and the respective sound output devices based on the calculated distances; and calculating coordinates of the respective sound output devices based on the distances and the angles.

According to an aspect of another exemplary embodiment, the display apparatus may further include a user remote section including a microphone capable of receiving a sound, and the sound control method including: receiving latency information about the sound pattern, received in the microphone of the user remote section, through wireless communication; determining a position of the user remote section based on the received latency information; determining relative positions between the user remote section and the respective sound output devices; and controlling the sound signal processor so that the sound signal processed corresponding to the determined relative positions can be respectively transmitted to the plurality of sound output devices.

According to an aspect of another exemplary embodiment, the display apparatus may further include a first microphone and a second microphone adjacent to the first sound output section and the second sound output section, and the sound control method may include by the first microphone and the second microphone, receiving preset sound patterns respectively output from the plurality of sound output devices; and calculating the distances between the first sound output section and the respective sound output devices and the distances between the second sound output section and the respective sound output devices, based on the latency information of the received sound pattern, when According to an aspect of another exemplary embodiment, the sound control method may further include calculating angles between the first sound output section and the respective sound output devices and between the second sound output section and the respective sound output devices, based on the calculated distances; and calculating coordinates of the respective sound output devices based on the distances and the angles.

According to an aspect of an exemplary embodiment, a sound output device connected to a display apparatus may be provided, the sound output device including: a sound output section; a wireless communication section which wirelessly communicates with the display apparatus; a microphone which receives a sound; and a controller which synchronizes clocks with the display apparatus in accordance with synchronous signals received from the display apparatus, and transmits latency information about a sound pattern received in the microphone to the display apparatus.

According to an aspect of an exemplary embodiment, a sound output device connected to a display apparatus may be provided, the sound output device including: a sound output section; a wireless communication section which wirelessly communicates with the display apparatus; and a controller which synchronizes clocks with the display apparatus in accordance with synchronous signals received from the display apparatus, and controls the sound output section to output a preset sound pattern to the display apparatus.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION OF EXEMPLARY EMBODIMENTS

Figure 1:
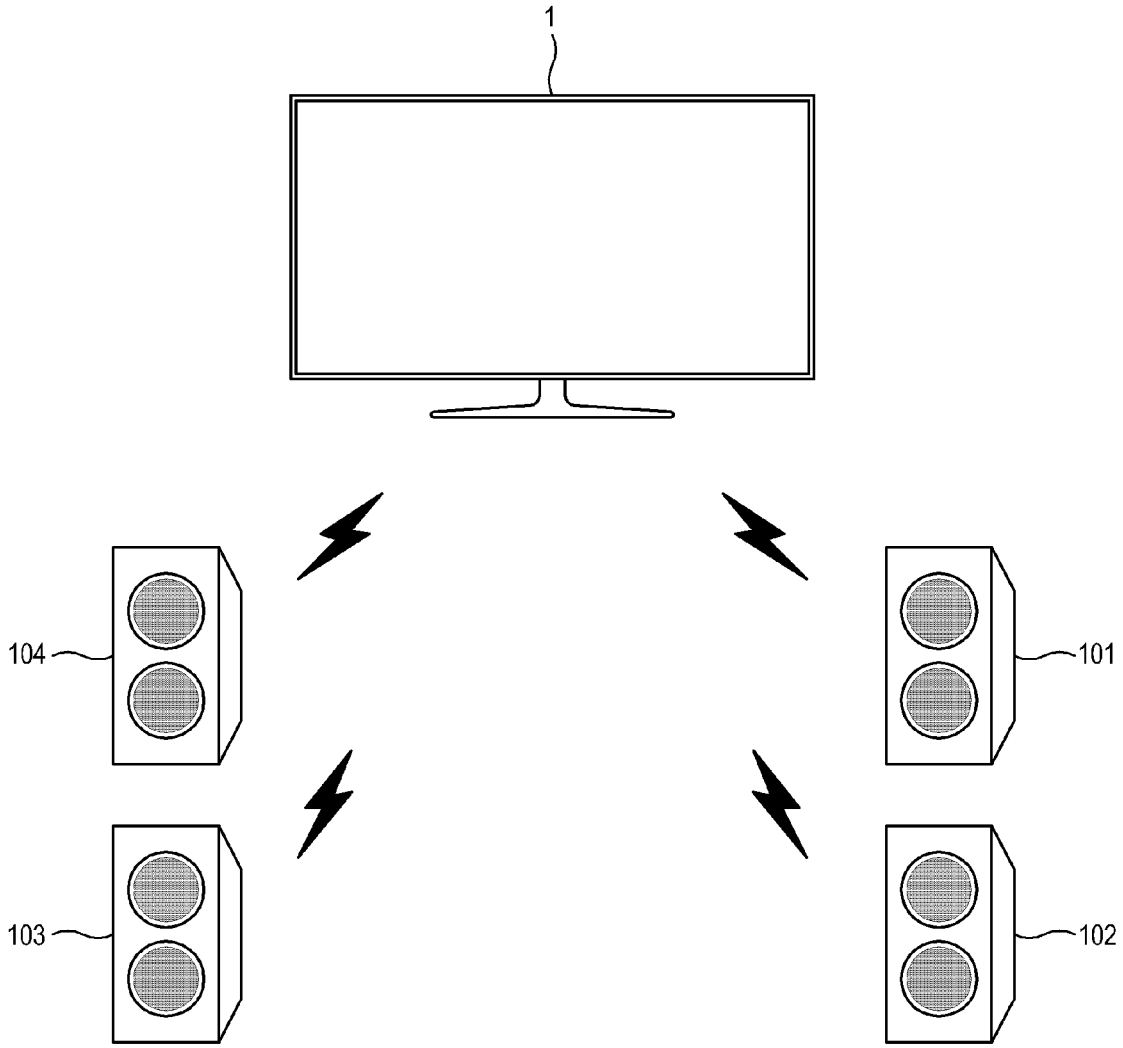
FIG. 1 is a schematic view of a display apparatus and a sound output device according to an exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

FIG. 1 is a schematic view of a display apparatus and a sound output device according to an exemplary embodiment. As shown therein, the display apparatus 1 and the plurality of sound output devices 101, 102, 103, 104 are wirelessly connected to each other. The display apparatus 1 may be achieved by a television as shown therein, and may include various audio/video (AV) devices connected to the content source and processing/outputting an image and a sound. The sound output devices 101, 102, 103, 104 are connected to the display apparatus 1 and output a sound given from the display apparatus 1. Recently, a home theater system has been materialized to give a big and vivid image and sound effect through a large screen and a stereophonic sound in a general home like a movie theater. To this end, various AV devices or the like have been actively developed. The sound output devices used in such a home theater may include a subwoofer and five speakers having directionality. Each speaker outputs a sound transmitted through a plurality channels, e.g., 5.1 channels. Of course, the speaker may be added. The more the number of speakers, the better the stereophony of the sound. For convenience of description only four sound output devices 101, 102, 103, 104 are exemplarily illustrated in the drawings.

In this embodiment, the display apparatus 1 and the sound output device 104 may be connected by wireless communication such as Bluetooth or WiFi as well as wired communication such as a cable, and transmit and receive sound contents through a communication protocol based on digital living network alliance (DLNA). Thus, it is convenient for a user to readily connect the devices through a Wi-Fi protected setup (WPS) button or the like without direct connection of the cable.

Also, in this embodiment, when the display apparatus 1 and the sound output devices 101, 102, 103, 104 are wirelessly connected to each other, a relation between their positions is automatically recognized, thereby distributing the sounds to the respective sound output devices 101, 102, 103, 104 in accordance with the recognized position relation.

Figure 2:
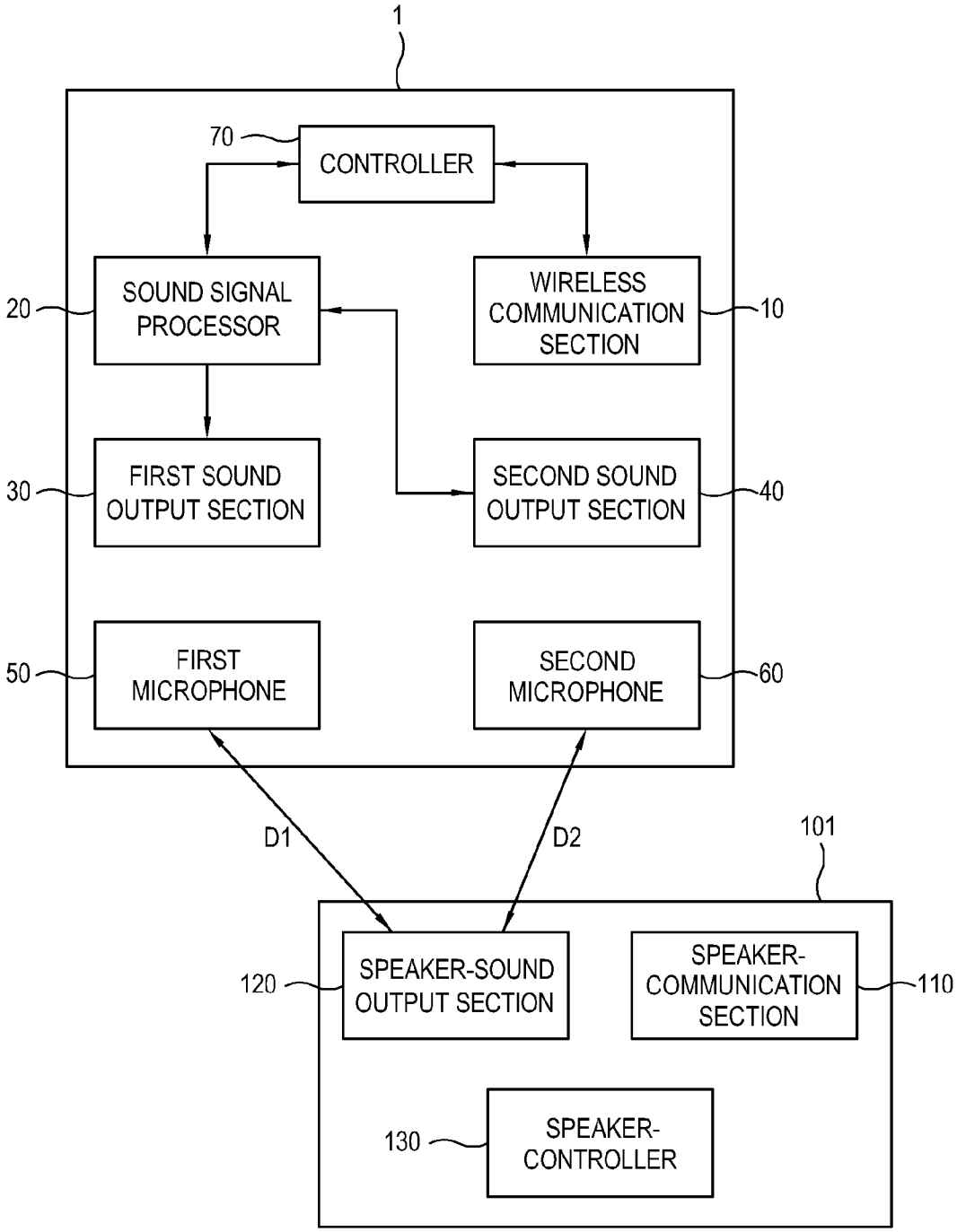
FIG. 2 is a control block diagram of the display apparatus and the sound output device of FIG. 1.

FIG. 2 is a control block diagram of the display apparatus and the sound output device of FIG. 1. As shown therein, in this embodiment, the display apparatus 1 includes a wireless communication section 10 for communicating with the plurality of sound output devices 101, 102, 103, 104; a sound signal processor 20 for processing a sound signal of contents received from the content source or a previously stored sound signal; a first sound output section 30 and a second sound output section 40 for outputting the processed sound signal; a first microphone 50 adjacent to the first sound output section 30 and a second microphone 60 adjacent to the second sound output section 40; and a controller 70 for generally controlling the various components described. Of course, the display apparatus 1 includes a video processor (not shown) and a display section (not shown).

For convenience of description, FIG. 2 shows only one 101 among the plurality of sound output devices 101, 102, 103, 104, and the plurality of sound output devices 101, 102, 103, 104 may have substantially the same configuration as the illustrated sound output device 101. The sound output device 101 includes a speaker-communication section 110 for communicating with the display apparatus 1, a speaker-sound output section 120 for outputting the sound signal transmitted from the display apparatus 1 or the previous stored sound signal, and a speaker-controller 130 controlling the speaker-sound output section 120 and the speaker-communication system.

The wireless communication section 10 and the speaker-communication section 110 exchange certain information with each other through a preset communication protocol when a user selects wireless communication, and the apparatuses mutually each other, thereby starting the communication. Various control and sound signals are transmitted and received through the wireless communication section 10 and the speaker-communication section 110.

The sound signal processor 20 processes the sound signal contained in contents and outputs it to the first sound output section 30 and the second sound output section 40. Also, the sound signal processed in the sound signal processor 20 is transmitted to the plurality of sound output devices 101, 102, 103, 104 through the wireless communication section 10. In accordance with various known methods, the sound signal is controlled with regard to various parameters such as phase, volume, noise, etc., in accordance with channels.

The first sound output section 30, the second sound output section 40 and the speaker-sound output section 120 outputs a sound audible for a user, based on the sound signal processed by the sound signal processor 20. The sound signals output from each output sections 30, 40, 120 may be the same or different. The first sound output section 30 and the second sound output section 40 may be arranged in front of the display apparatus 1, and two output sections 30, 40 may be arranged leaving a predetermined distance from each other. The speaker-sound output section 120 outputs a preset sound pattern under control of the speaker-controller 130.

The first microphone 50 and the second microphone 60 adjacent to the first sound output section 30 and the second sound output section 40 may receive a sound generated in the exterior. In this embodiment, the first microphone 50 and the second microphone 60 receives a sound pattern output from the sound output device 101.

The controller 70 determines the position of the sound output unit 101 based on a distance between the sound output device 101 and the first sound output section 30 and a distance between the sound output device 101 and the second sound output section 40. Also, the sound signal processor 20 is controlled so that the sound signal processed corresponding to the determined position can be transmitted to the sound output device 101.

First, when the controller 70 is wirelessly connected to the sound output device 101, the sound signal processor 20 and the sound output device 101 are synchronized with respect to a clock (not shown). The speaker-controller 130 also synchronizes with the display apparatus 1 with respect to the clock under the control signal of the controller 70. That is, two apparatuses 1 and 101 are synchronized with regard to the clock, so that they can recognize timing of sound generation and coordinate output with other. Such clock synchronization is to determine latency information about sound generation and transmission of a sound.

After the clock synchronization, the speaker-sound output section 120 of the sound output device 101 outputs a sound pattern. The output sound pattern is received in the display apparatus 1 through the first microphone 50 and the second microphone 60. Before the output sound pattern is transmitted to the first microphone 50 and the second microphone 60 of the display apparatus 1, a predetermined time delay, i.e., latency is generated. Based on such latency information, the controller 70 calculates a distance D1 (hereinafter, referred to as a "first distance") between the sound output device 101 and the first sound output section 30 and a distance D2 (hereinafter, referred to as a "second distance") between the sound output device 101 and the second sound output section 40. If the first distance D1 and the second distance D2 are not the same, i.e., one of them is longer or shorter than the other one, it means that the sound output device 101 is not positioned in front of the display apparatus 1 but arranged left or right with respect to the display apparatus 1. That is, it will be understood that the sound output device 101 is deviated rightward or leftward with respect to a direction that a user looks. Also, the controller 70 can calculate each distance information of the plurality of sound output devices 101, 102, 103, 104 and thus determine it as a relative position of the plurality of sound output devices 101, 102, 103, 104. That is, it is possible to determine which sound output device is a left or right sound output device or a front or rear sound output device in accordance with the latency information of the sound patterns received in the first microphone 50 and the second microphone 60.

The controller 70 transmits information about a relative position between the plurality of sound output devices 101, 102, 103, 104 to the sound signal processor 20, and the sound signal processor 20 processes the sound signal in accordance with the received position information. The sound signal may be adjusted in various parameters such as a tone, a volume, a phase, a frequency, etc. in accordance with the plurality of sound output devices 101, 102, 103, 104.

Figure 3:
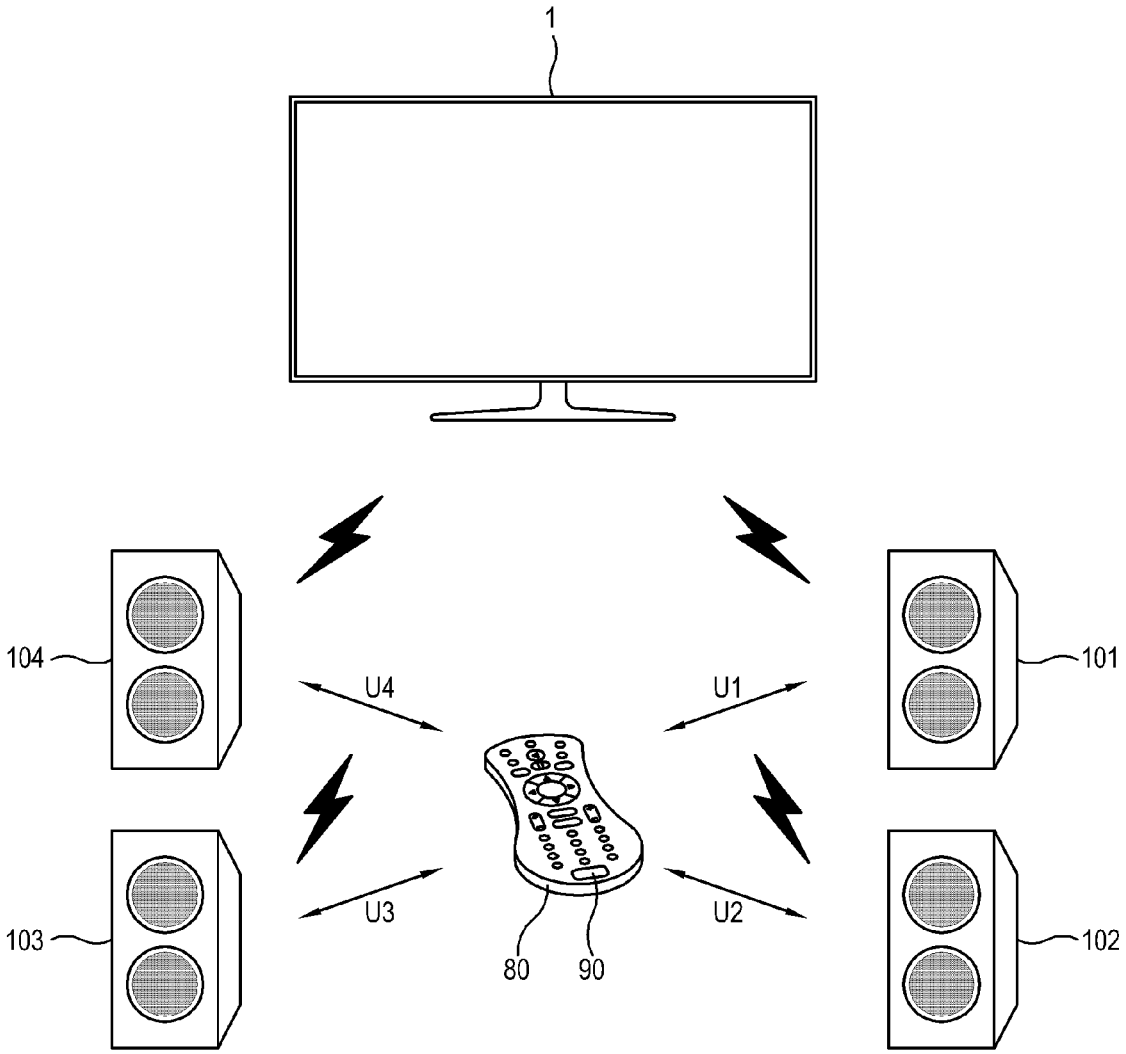
FIG. 3 is a schematic view of a display apparatus and a sound output device according to another exemplary embodiment.

FIG. 3 is a schematic view of a display apparatus and a sound output device according to another exemplary embodiment. As shown therein, in this embodiment, the display apparatus 1 includes a user input section 80 to be remotely controlled by a user. In this case, the wireless communication section 10 of the display apparatus 1 and the user input section 80 may wirelessly communicate with each other. Also, the user input section 80 may be provided as a device for controlling the sound output devices 101, 102, 103, 104. The user input section 80 may be achieved by any device that includes a third microphone 90 and is capable of communicating with the wireless communication section 10 of the display apparatus 1.

Like the first microphone 50 and the second microphone 60 of the display apparatus 1, the third microphone receives the sound patterns output from the sound output 90 devices 101, 102, 103, 104, and provides the latency information from time when the sound pattern is output to time when the sound pattern is received in the user input section 80 to the controller 70. To this end, if the display apparatus 1 and the sound output devices 101, 102, 103, 104 are connected, the user input section 80 is clock-synchronized and communicates with the controller 70 through the existing IR communication section or the like.

The controller 70 calculates respective distances U1, U2, U3, U4 between the user input section 80 and the plurality of sound output devices 101, 102, 103, 104 based on the latency information received from the user input section 80 through the wireless communication section 10. Through this, the controller 70 determine the relative positions between a user controlling the user input section 80 and the sound output devices 101, 102, 103, 104. For example, as shown therein, it may be determined that a user is located on the left side of the first sound output device 101 and the second sound output device 102, and also located between the first sound output device 101 and the second sound output device 102. Also, it may be determined that a user is located on the right side of the third sound output device 103 and the fourth sound output device 104 and also located between the third sound output device 103 and the fourth sound output device 104. In accordance with such relative positions, the first sound output device 101 and the second sound output device 102 output a sound for a user's right ear; the third sound output device 103 and the fourth sound output device 104 output a sound for a user's left ear; the first sound output device 101 and the fourth sound output device 104 outputs a front sound; and the second sound output device 102 and the third sound output device 103 outputs a rear sound.

Like this, in this embodiment, a user's relative location is determined to process a sound. Therefore, even though a user's relative location is changed, it is reflected on the control of the sound.

Figure 4:
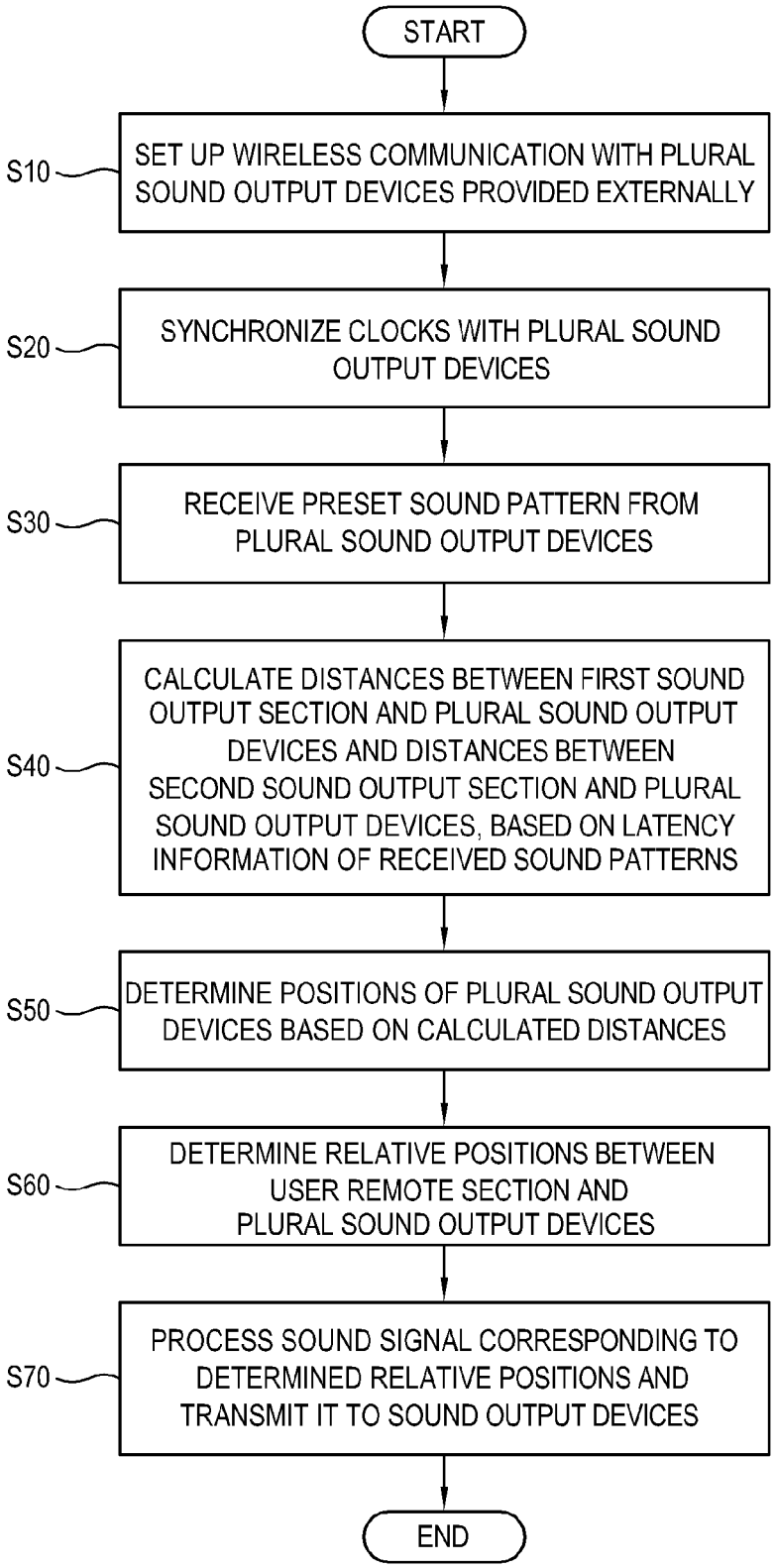
FIG. 4 is a control flowchart for explaining a sound control method of the display apparatus and the sound output device of FIG. 3.

FIG. 4 is a control flowchart for explaining a sound control method of the display apparatus and the sound output device of FIG. 3. Referring to FIG. 4, the sound control method in this embodiment is as follows.

First, the controller 70 controls the wireless communication section 10 and the speaker-communication section 110 and thus sets up the wireless communication with the plurality of external sound output devices 101, 102, 103, 104, thereby starting communication (S10).

If the plurality of sound output devices 101, 102, 103, 104 are wirelessly connected, the controller 70 synchronizes with clocks of the plurality of sound output devices 101, 102, 103, 104 (S20).

Then, receive preset sound patterns sequentially output from the plurality of respective sound output devices 101, 102, 103, 104 through the first microphone 50 and the second microphone 60 adjacent to the first sound output section 30 and the second sound output section 40 (S30).

The controller 70 calculates the distances between the first sound output section 30 and each of the sound output devices 101, 102, 103, 104, and the distances between the second sound output section 40 and each of the sound output devices 101, 102, 103, 104, based on the latency information of the received sound pattern (S40).

The controller 70 can determine each position of the plurality of sound output devices 101, 102, 103, 104 based on the distances (S50). For example, it is possible to determine whether the sound output device 101, 102, 103, 104 is positioned on the right or left side of the display apparatus 1, and whether the sound output device 101, 102, 103, 104 is positioned in front or rear.

Also, the controller 70 receives the latency information about the sound pattern, which is received in the third microphone 90 of the user input section 80, through the wireless communication section 10, and determines the relative positions between the user input section 80 and each of the sound output devices 101, 102, 103, 104, based on the latency information (S60).

The controller 70 controls the sound signal processor 20 to process the sound signal corresponding to the determined relative positions, and transmits the processed sound signals to the plurality of sound output devices 101, 102, 103, 104, respectively (S70).

Figure 5:
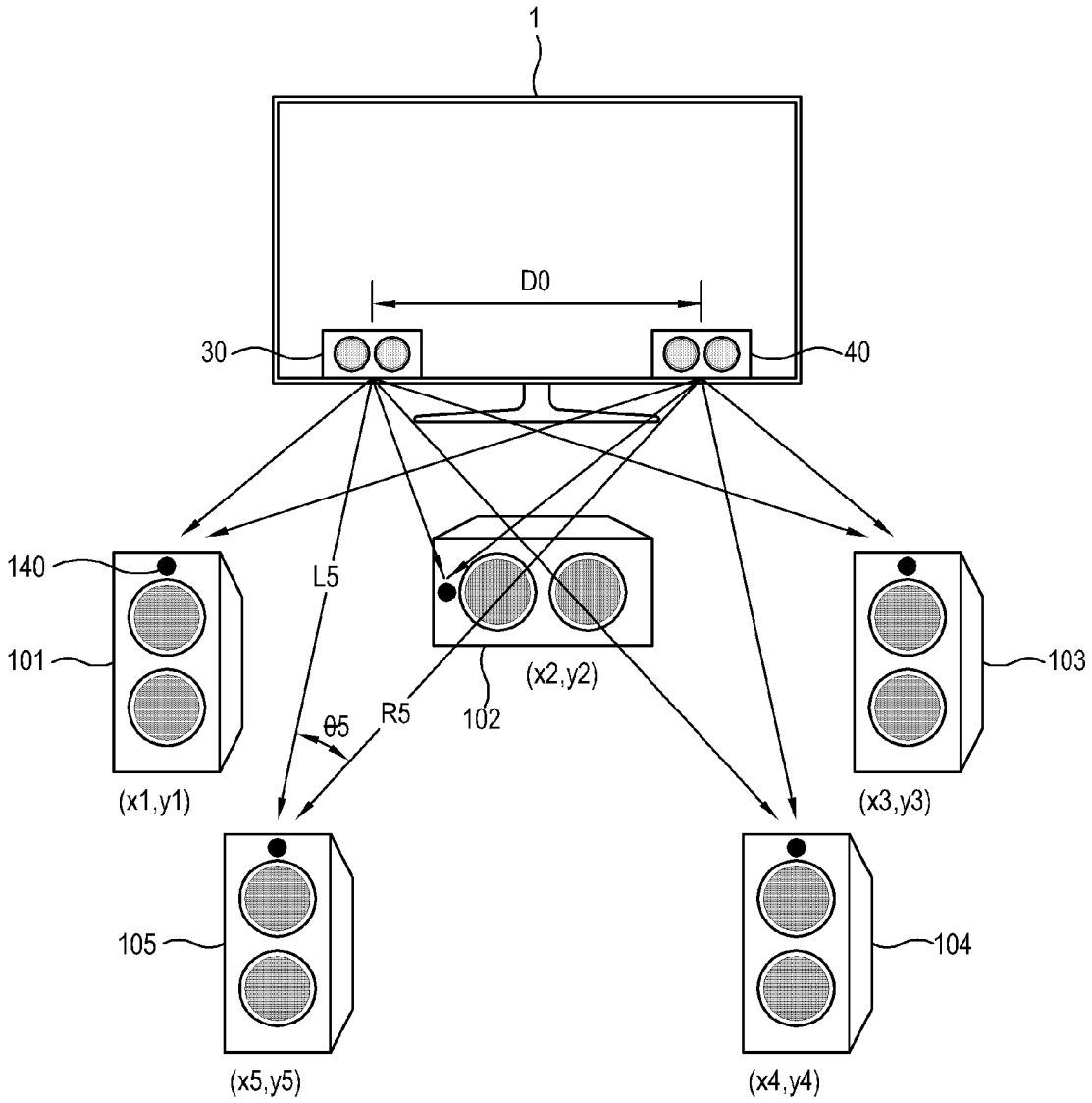
FIG. 5 is a schematic view of a display apparatus and a sound output device according to still another exemplary embodiment.

FIG. 5 is a schematic view of a display apparatus and a sound output device according to still another exemplary embodiment. As shown therein, in this embodiment, five sound output devices 101, 102, 103, 104, 105 are connected to the display apparatus 1, and a microphone 140 is included in not the display apparatus 1 but the plurality of sound output devices 101, 102, 103, 104, 105. The elements included in the display apparatus 1 and the sound output devices 101, 102, 103, 104, 105 are substantially the same as those of FIG. 2 except the microphone.

Accordingly, the preset sound pattern is output from the first sound output section 30 and the second sound output section 40 of the display apparatus 1, and the output sound pattern is received in the fourth microphones 140 included in the sound output devices 101, 102, 103, 104, 105.

The controller 70 receives the latency information about the sound patterns received in the microphones 140 of the sound output devices 101, 102, 103, 104, 105 through the wireless communication section 10, and calculates distances between the first sound output section 30 and the respective sound output devices 101, 102, 103, 104, 105 and distances between the second sound output section 40 and the respective sound output devices 101, 102, 103, 104, 105, based on the received latency information. For example, let the first sound output section 30 correspond to a left speaker of the display apparatus 1, and let a distance between a fifth sound output device 105 and the first sound output section 30 be L5. Then, the display apparatus 1 determines L1, L2, L3, L4, L5, and calculates the distances R1, R2, R3, R4, R5 between the second sound output section 40 corresponding to the right speaker of the display apparatus 1 and the respective sound output devices 101, 102, 103, 104, 105. Because the distance DO between the first sound output section 30 and the second sound output section 40 is invariable, the controller 70 can calculate internal angles of triangles, vertexes of which are formed by each the sound output devices 101, 102, 103, 104, 105, the first sound output section 30 and the second sound output section 40. The controller 70 calculates an angle θ5 between two known sides, e.g., between L5 and R5, based on the second cosine rule. Since the lengths of three sides and three angles are known, the controller 70 can determine individual coordinates of the sound output devices 101, 102, 103, 104, 105 with respect to a certain reference vertex. As shown therein, the first sound output device 101 has the coordinates (x1, y1). Likewise, the coordinates of the other sound output devices 102, 103, 104, 105 can be obtained in the same manner. Through this calculation, up the controller 70 can automatically recognize the positions of the plurality of sound output devices 101, 102, 103, 104, 105 without any manual setup for the positions. Based on such position information, the sound signal is controlled.

If the sound output devices 101, 102, 103, 104, 105 are changed in configuration or position after the positions of the sound output devices 101, 102, 103, 104, 105 are determined, the controller 70 may display a notice message for informing a user of this change and receive a user's selection. That is, before automatically renewing the sound setup, a user may be informed of change in the positions of the sound output devices 101, 102, 103, 104, 105 and confirm whether s/he wants the change in the output sound.

Figure 6:
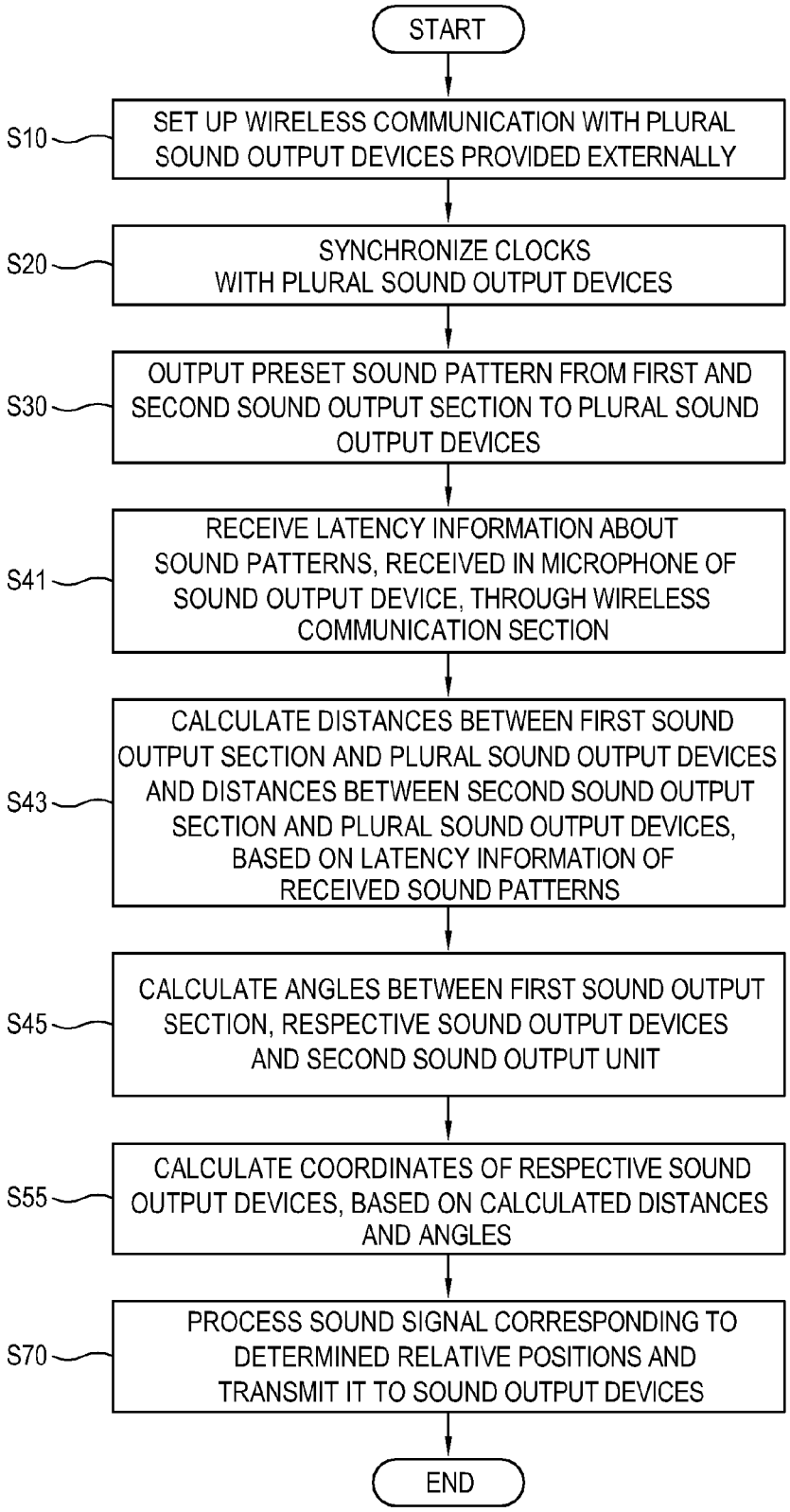
FIG. 6 is a control flowchart for explaining a sound control method of the display apparatus and the sound output device of FIG. 5.

FIG. 6 is a control flowchart for explaining a sound control method of the display apparatus and the sound output device of FIG. 5.

The processes that the controller 70 sets up the wireless communication with the plurality of sound output devices 101, 102, 103, 104, 105 and starts the communication (S10), and synchronizes clocks with the clocks of the plurality of sound output devices 101, 102, 103, 104, 105 (S20) are the same as those of FIG. 4.

In this embodiment, the first sound output section 30 and the second sound output section 40 of the display apparatus 1 sequentially output the sound patterns to the sound output devices 101, 102, 103, 104, 105 (S30). To this end, each of the sound output devices 101, 102, 103, 104, 105 may include the fourth microphone 140 capable of receiving a sound.

Then, the controller 70 receives the latency information about the sound patterns, which are received by the fourth microphones 140 of the respective sound output devices 101, 102, 103, 104, 105, through the wireless communication section 10 (S41). Based on the received latency information, the controller 70 calculates the distances L1, L2, L3, L4, L5 between the first sound output section 30 and each of the sound output devices 101, 102, 103, 104, 105 and the distances R1, R2, R3, R4, R5 between the second sound output section 40 and each of the sound output devices 101, 102, 103, 104, 105 (S43).

The controller 70 calculates the internal angles θ1, θ2, θ3, θ4, θ5 of the respective sound output devices 101, 102, 103, 104, 105 with regard to the first sound output section 30 and the second sound output section 40, using the calculated distances L1, L2, L3, L4, L5, R1, R2, R3, R4, R5, the distance D0 between the first sound output section 30 and the second sound output section 40, and the second cosine rule (S45).

The controller 70 calculates respective coordinates (x1, y1), (x2, y2), (x3, y3), (x4, y4), (x5, y5) of the respective sound output devices 101, 102, 103, 104, 105, based on the finally calculated distance and angle (S55).

The sound signal processor 20 processes the sound signals corresponding to the relative positions determined under the control, and transmits the processed sound signals to the plurality of sound output devices 101, 102, 103, 104, respectively (S70).

If the coordinates of the respective sound output devices 101, 102, 103, 104, 105 are determined based on such calculation using the distances and the angles, the sound output devices 101, 102, 103, 104, 105 output the sound patterns and the display apparatus 1 receives them.

Figure 7:
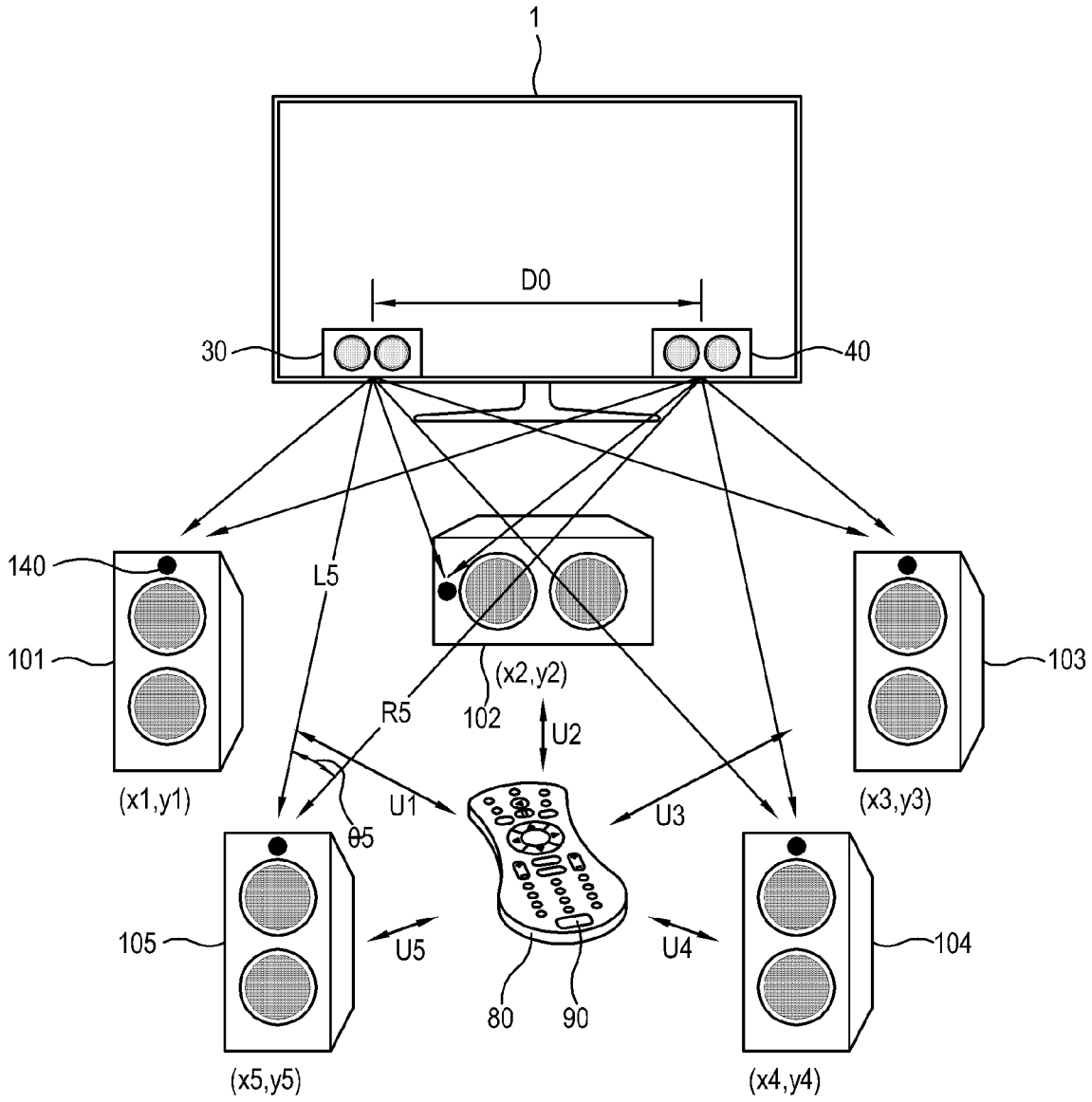
FIG. 7 is a schematic view of a display apparatus and a sound output device according to yet another exemplary embodiment.

FIG. 7 is a schematic view of a display apparatus and a sound output device according to yet another exemplary embodiment. As shown therein, in this embodiment, the display apparatus 1 or the sound output devices 101, 102, 103, 104, 105 may further include the user input section 80, and the user input section 80 includes a third microphone 90.

The latency information for calculating the distances between a user and the sound output devices 101, 102, 103, 104, 105 is obtained from the sound patterns received in the third microphone 90, and the controller 70 calculates the distances and the angles between the user input section 80 and the sound output devices 101, 102, 103, 104, 105, thereby determining the coordinates of the user input section 80.

When the coordinates of the user input section 80 are calculated, the controller 70 can determine all the relative positions between a user and the plurality of sound output devices 101, 102, 103, 104, 105. Based on the coordinates and the relative positions, the sound signal processor 20 processes the sound signals to be transmitted to the sound output devices 101, 102, 103, 104, 105, respectively.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus comprising:

a wireless communication section which wirelessly communicates with a plurality of external sound output devices;

a sound signal processor which processes a sound signal;

a first sound output section and a second sound output section which output sounds corresponding to the sound signals; and a controller which determines positions of the plurality of sound output devices based on distances between the first sound output section and the plurality of sound output devices and distances between the second sound output section and the respective plurality of sound output devices, and controls the sound signal processor so that the sound signals processed corresponding to the determined positions can be respectively transmitted to the plurality of sound output devices.

2. The display apparatus according to claim 1, wherein the controller synchronizes between the plurality of sound output devices based on a clock when the plurality of sound output devices are wirelessly connected.

3. The display apparatus according to claim 2, wherein each sound output device comprises a microphone, the first sound output section and the second sound output section output preset sound patterns, and the controller controls the wireless communication section to receive latency information about the sound patterns received in the respective microphones of the plurality of sound output devices, and calculates distances between the first sound output section and the plurality of sound output devices and distances between the second sound output section and the respective plurality of sound output devices based on the received latency information.

4. The display apparatus according to claim 3, wherein the controller calculates angles between a first line connecting the first sound output section and a the respective sound output devices and a second line connecting the second sound output section and the respective sound output devices based on distances between the first sound output section and the respective sound output devices, distances between the second sound output section and the respective sound output devices, and a distance between the first sound output section and the second sound output section, and calculates coordinates of the respective sound output devices based on the distances and the angles.

5. The display apparatus according to claim 4, further comprising a user remote section comprising a microphone capable of receiving a sound, wherein the controller receives latency information about the sound pattern, received in the microphone of the user remote section, through the wireless communication section, determines a position of the user remote section based on the received latency information, determines relative positions between the user remote section and the respective sound output devices, and controls the sound signal processor so that the sound signal processed corresponding to the determined relative positions can be respectively transmitted to the plurality of sound output devices.

6. The display apparatus according to claim 2, further comprising a first microphone and a second microphone adjacent to the first sound output section and the second sound output section, wherein the controller calculates distances between the first sound output section and respective sound output devices and distances between the second sound output section and the respective sound output devices, based on the latency information of the received sound pattern, when the first microphone and the second microphone receive preset sound patterns respectively output from the plurality of sound output devices.

7. The display apparatus according to claim 6, wherein the controller calculates angles between a first line connecting the first sound output section and the respective sound output devices and a second line between the second sound output section and the respective sound output devices, based on distances between the first sound output section and the respective sound output devices, distances between the second sound output section and the respective sound output devices, and a distance between the first sound output section and the second sound output section, and calculates coordinates of the respective sound output devices based on the distances and the angles.

8. The display apparatus according to claim 6, further comprising a user remote section comprising a third microphone capable of receiving a sound, wherein the controller receives latency information about the sound pattern, received in the third microphone, through the wireless communication section, determines relative positions between the user remote section and the respective sound output devices based on the received latency information, and controls the sound signal processor so that the sound signal processed corresponding to the determined relative positions can be respectively transmitted to the plurality of sound output devices.

9. A sound control method of a display apparatus comprising a first sound output section and a second sound output section which output sounds, the sound control method comprising:

setting up wireless communication with a plurality of sound output devices;

calculating distances between the first sound output section and the plurality of sound output devices and distances between the second sound output section and the respective plurality of sound output devices;

determining positions of the respective sound output devices based on the distances;

processing the sound signals corresponding to the determined positions; and transmitting the processed sound signals to the respective sound output devices.

10. The sound control method according to claim 9, further comprising synchronizing between the plurality of sound output devices using a clock when the plurality of sound output devices are wirelessly connected.

11. The sound control method according to claim 10, wherein the respective sound output devices comprise microphones, and the sound control method comprising:

by the first sound output section and the second sound output section, outputting preset sound patterns;

receiving latency information about the sound patterns received in respective microphones of the plurality of sound output devices, through wireless communication; and calculating distances between the first sound output section and the respective sound output devices and distances between the second sound output section and the respective sound output devices based on the latency information.

12. The sound control method according to claim 11, further comprising:

calculating angles between a line connecting the first sound output section and the respective sound output devices and a line connecting the second sound output section and the respective sound output devices based on the calculated distances; and calculating coordinates of the respective sound output devices based on the distances and the angles.

13. The sound control method according to claim 12, wherein the display apparatus further comprises a user remote section comprising a microphone capable of receiving a sound, and the sound control method comprising:

receiving latency information about the sound pattern, received in the microphone of the user remote section, through wireless communication;

determining a position of the user remote section based on the received latency information;

determining relative positions between the user remote section and the respective sound output devices; and controlling the sound signal processor so that the sound signal processed corresponding to the determined relative positions can be respectively transmitted to the plurality of sound output devices.

14. The sound control method according to claim 10, wherein the display apparatus further comprises a first microphone and a second microphone adjacent to the first sound output section and the second sound output section, and the sound control method comprises:

by the first microphone and the second microphone, receiving preset sound patterns respectively output from the plurality of sound output devices; and calculating distances between the first sound output section and respective sound output devices and distances between the second sound output section and the respective sound output devices, based on the latency information of the received sound pattern.

15. The sound control method according to claim 14, further comprising:

calculating angles between a first line connecting the first sound output section and the plurality of sound output devices and a second line connecting the second sound output section and the respective plurality of sound output devices, based on the calculated distances; and calculating coordinates of the respective sound output devices based on the distances and the angles.

16. The sound control method according to claim 14, wherein the display apparatus further comprises a user remote section comprising a third microphone capable of receiving a sound, the sound control method comprises receiving latency information about the sound pattern, received in the third microphone, through wireless communication;

determining relative positions between the user remote section and the respective plurality of sound output devices based on the received latency information; and controlling the sound signal processor so that the sound signal processed corresponding to the determined relative positions can be respectively transmitted to the plurality of sound output devices.

17. A sound output device connected to a display apparatus, the sound output device comprising:

a sound output section;

a wireless communication section which wirelessly communicates with the display apparatus;

a microphone which receives a sound; and a controller which synchronizes clocks with the display apparatus in accordance with synchronous signals received from the display apparatus, and transmits latency information about a sound pattern received in the microphone to the display apparatus.

18. A sound output device connected to a display apparatus, the sound output device comprising:

a sound output section;

a wireless communication section which wirelessly communicates with the display apparatus; and a controller which synchronizes clocks with the display apparatus in accordance with synchronous signals received from the display apparatus, and controls the sound output section to output a preset sound pattern to the display apparatus.

19. A display apparatus comprising:

a first sound output section and a second sound output section which output sounds corresponding to sound signals received from a sound processor; and a controller which determines a position of at least one external sound output device based on a first distance between the first sound output section and the at least one external sound output device and a second distance between the second sound output section and the at least one external sound output device, and controls the sound signal processor based on the position.

20. A sound control method comprising:

calculating a first distance between a first sound output section and at least one external sound output device;

calculating a second distance between a second sound output section and the at least one external sound output device;

determining a position of the at least one external sound output device;

processing sound signals corresponding to the determined position; and transmitting the processed sound signals to the at least one external sound output device.

* * * * *